United States Patent [19]

Huber

[11] 4,220,940

[45] Sep. 2, 1980

[54] SPIDER ASSEMBLY FOR A HIGH VOLTAGE FUSE

[75] Inventor: William J. Huber, Waukesha, Wis.

[73] Assignee: RTE Corporation, Waukesha, Wis.

[21] Appl. No.: 948,909

[22] Filed: Oct. 5, 1978

[51] Int. Cl.[2] ..... H01H 85/16

[52] U.S. Cl. ..... 337/231; 337/234

[58] Field of Search ..... 337/158, 159, 207, 208, 337/231, 234, 251, 252

[56] References Cited

U.S. PATENT DOCUMENTS

| | | | |
|---|---|---|---|
| 3,775,769 | 8/1973 | Milkulecky | 337/158 |
| 3,962,666 | 6/1976 | Knapp, Jr. | 337/252 |
| 4,057,775 | 11/1977 | Biller | 337/186 |

*Primary Examiner*—George Harris

*Attorney, Agent, or Firm*—Ronald E. Barry

[57] ABSTRACT

A six rib spider assembly for a fuse including a dielectic housing having end caps for supporting the spider assembly within the housing and a fusable ribbon helically wound on the spider assembly, the housing being filled with a granular dielectic material. The spider assembly including three mica plates each having a number of notches in their longitudinal edges to define support surfaces along each longitudinal edge for the fusable ribbon. These support surfaces on each longitudinal edge being offset from the support surfaces on the opposite longitudinal edge as well as from the support surfaces on each of the other mica plates. Each plate also including at least one longitudinal slot intermediate the longitudinal edges of the plate with one of the plates including a second slot, whereby the plates can be cross fitted into each other with the plates angularly related so that the support surfaces define a helical path for the fusable ribbon.

10 Claims, 7 Drawing Figures

SPIDER ASSEMBLY FOR A HIGH VOLTAGE FUSE

BACKGROUND OF INVENTION

Spider assemblies for supporting fusable ribbon elements have been fabricated from numerous materials mainly classified as good dielectics either gas evolving (organic) or non-gas evolving (in-organic). It has been the general practice to use mylar (organic) and mica with in-organic binders to make four ribbed spiders. These have been fabricated with and without notches in the ribs. Ceramic spiders generally do not have notches as the cost of producing them is prohibitive. Efforts to increase the number of ribs to six have been limited due to the additional cost and the difficulty of extruding a six rib structure and the cost of cutting notches in the ribs.

SUMMARY OF THE INVENTION

The six rib spider assembly of the present application is formed from three mica plates each having a slot intermediate the longitudinal edges of the plates with one of the plates including a second slot so that the plates can be cross fitted into each other. Each of the plates is shaped differently in order to provide a predetermined pitch to the support surfaces defined on the longitudinal edges of the plates for supporting the fusable ribbon. This arrangement provides a more circular circumference and an increased ribbon length for the same length spider. The notches provided between the support surfaces provide a barrier to prevent arcing between the fused ribbon on adjacent support surfaces.

DRAWINGS

DESCRIPTION OF INVENTION

Figure 1:
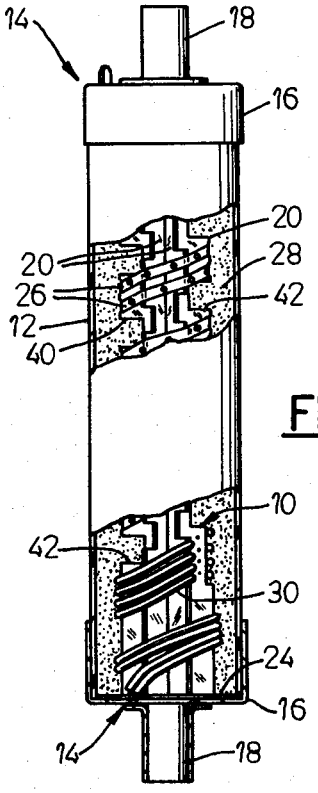
FIG. 1 is an elevation view partly broken away to show the spider assembly supporting a dual range fusable ribbon within a fuse housing.

Referring to FIG. 1 of the drawing the spider assembly according to the invention is shown mounted in a cylindrical insulating housing 12 and supported therein by an end cap assembly 14 provided on each end of the housing 12. The cylindrical housing is generally formed from a suitable dielectic material such as a plastic resin. The end cap assemblies each include a metallic cap 16 which is mounted over the end of the cylindrical housing and has a circuit connecting member 18 provided on each end cap. The end caps are sealed to the housing in a conventional manner.

Figure 3:
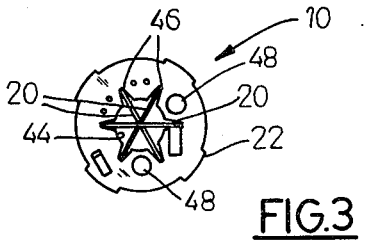
FIG. 3 is an end view of one end of the spider assembly shown in FIG. 2.
Figure 2:
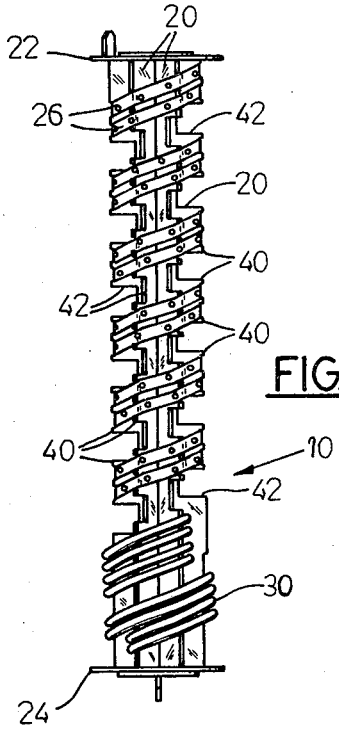
FIG. 2 is a view of the spider assembly with the fusable ribbon helically wound on the support surfaces.
Figure 4:
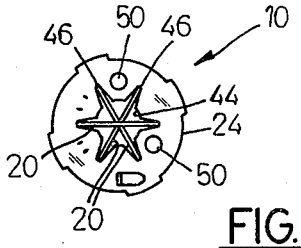
FIG. 4 is an end view of the other end of the spider assembly shown in FIG. 2.

Referring to FIGS. 2, 3 and 4 the spider assembly 10 includes a number of flat support plates 20 which are closely fitted together and held in a fixed relation with respect to each other by conductive metallic plates 22 and 24. The plates 22 and 24 are provided at each end of the support plates 20. A pair of fusable ribbons 26 are shown helically wound about the outer edges of the support plates 20 and soldered to the metallic plates 22 and 24 at each end of the fusable ribbon.

The cylindrical housing 12 can be filled with a suitable granular dielectic material 28 such as silica sand or coarse sand which entirely surrounds the fusable ribbon 26. The fusable ribbons are fabricated from silver, although other alloys are usable, and dimensioned to melt when a predetermined magnitude of current is conducted through the ribbon. The ribbons are insulated by the dielectic material 28.

A second fusable element assembly 30 can be provided on the end of the fusable ribbons if a full range fuse is desired.

Figure 5:
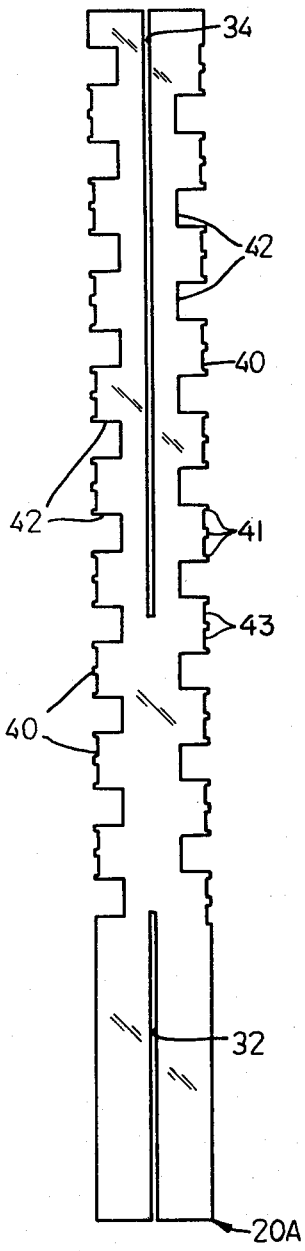
FIG. 5 is a plan view of one of the spider plates.
Figure 6:
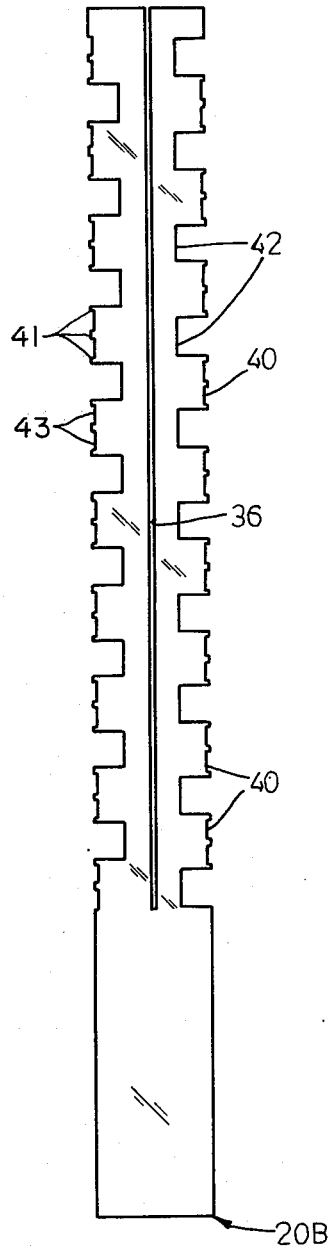
FIG. 6 is a plan view of the second spider plate.
Figure 7:
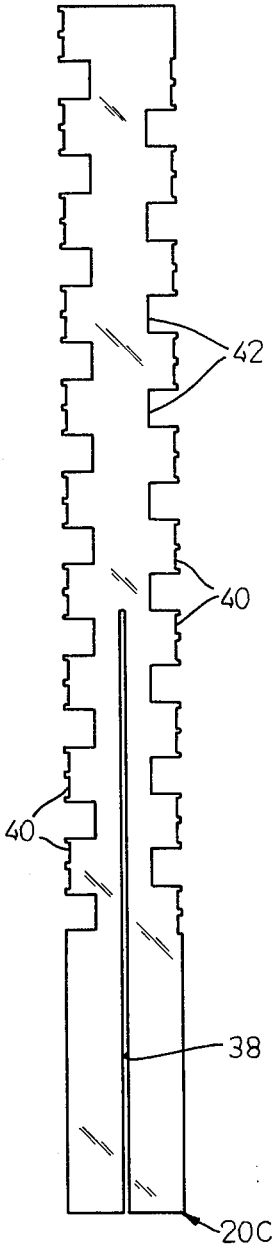
FIG. 7 is a plan view of the third spider plate.

Referring to FIGS. 5, 6 and 7 the support plates 20 are shown and individually numbered 20A, 20B and 20C. Each plate is in the form of a flat sheet like member formed of a suitable dielectic material such as mica paper. Slot means are provided in each of the plates to allow the plates to be cross fitted to form the spider assembly for the fusable ribbon.

In this regard the plate 20A is provided with a pair of slots 32 and 34 of unequal length located intermediate the longitudinal edges of the plate 20A. The plate 20B includes a longitudinal slot 36 intermediate the longitudinal edges of plate 20B. The plate 20C includes a longitudinal slot 38 intermediate the longitudinal edges of the plate 20C.

It should also be noted that each of the plates includes a number of support surfaces 40 along each of their longitudinal edges. The support surfaces being separated by means of notches 42. In the preferred embodiment, the support surfaces 40 are equally spaced along each longitudinal edge with the support surfaces on each longitudinal edge being offset with respect to each other and also offset with respect to the support surfaces 40 provided on each of the other plates 20B and 20C. Each of the support surfaces 40 is separated by nibs 41 into two separate tracks 43.

The spider assembly is formed by cross fitting the slot 36 in plate 20B with the slot 32 in plate 20A and the slot 38 in plate 20C with the slots 34 in plate 20A and 36 in plate 20B. The combined length of the slots 32 and 36 should be equal to the length of one of the plates 20. The combined length of the slots 34 and 38 also should be equal to the length of one of the plates 20.

The plates 20 of the spider assembly are held in a predetermined angular relation i.e. 120 degrees, by means of the metallic terminator plates 22 and 24. In this regard each of the terminator plates includes a central aperture 44 with a plurality of notches 46 located 60 degrees apart to accommodate ends of the plates 20. The fusable ribbons 26 are wrapped around the support surfaces 40 in the tracks 43 in a spaced relation. The second fusable assemblies 30 are also helically wrapped around the support surfaces 40. Since each plate 20 is shaped different in that the support surfaces are offset with respect to each other, a predetermined pitch can be provided for the fusable ribbon 26 as they are helically wound about the assembled plates 20.

After assembly the spider assembly 10 is positioned in the cylindrical housing 12 with the metallic terminator plates 22 and 24 secured to the end caps 16. The housing 12 is then filled with the granular dielectic material 20. It should be noted that the granular material will fill the notches 42 between the support surfaces 40 thus providing insulating material between the turns of the fusable ribbons mounted on the support surfaces 40. The use of six ribs provides a greater circular circumference and thus an increased length for the fusable ribbons for the same length spider assembly.

The embodiments of the invention in which an exclusive property or privilege is claimed are defined as follows:

1. An improved spider assembly to support a fusable ribbon to be mounted within a housing which contains a granular dielectric material, the spider assembly comprising at least three plates having support surfaces along their longitudinal edges, each support surface on each plate being offset with respect to each other and with respect to the support surfaces on the other plates, each plate including at least one longitudinal slot intermediate the longitudinal edges of the plates whereby the plates can be cross fitted into each other with the plates being angularly related so that the support surfaces define a helical path for the fusable ribbon.

2. The spider assembly according to claim 1 wherein notches are provided in the longitudinal edges of the plate between each pair of support surfaces whereby dielectric material in the notches will insulate the turns of the ribbon from each other.

3. The spider assembly according to claim 1 wherein the support surfaces on each longitudinal edge of each plate includes a pair of equally spaced tracks to support a pair of fuse elements in an equally spaced relation.

4. The spider assembly according to claim 1 including means at each end of the spider assembly for maintaining the plates in a fixed angular relation.

5. The spider assembly according to claim 4 wherein said plates are spaced to provide ribs at 60 degrees intervals.

6. The spider assembly according to claims 1 or 2 wherein one of said plates includes a second longitudinal slot at the opposite end of the plate from the first longitudinal slot.

7. The spider assembly according to claim 6 wherein said plates are of equal length and the combined length of the first slot in said one of the plates and the slot in one of the other plates is equal to the length of said one of the plates and the combined length of the second slot in said one of said plates and the length of the slot in the other of said plates is equal to the length of said one of the plates.

8. A high voltage fuse comprising a cylindrical housing, a granular dielectric material in said housing and a spider assembly imbedded in said dielectric material said spider assembly including three mica plates of substantially equal length, each plate being slotted to cross-fit with the other plates to form six ribs, each of said ribs including a number of fuse support surfaces, said support surfaces on each of said ribs being offset from the support surfaces on each of the other ribs to form a helical fuse support path, and fuse means supported on the longitudinal edges of said ribs.

9. The fuse according to claim 8 wherein each of said plates includes a first slot and one of said plates includes a second slot, the slots being located intermediate the longitudinal edges of the plates.

10. The fuse according to claim 9 wherein the combined length of the second slot in said one of the said plates and the first slot in one of said other plates is equal to the length of a plate and the combined length of the first slot in said of one of said plates and the first slot in the second of said other plates is equal to the length of a plate.

* * * * *